US009398377B2

(12) United States Patent
Sunahara et al.

(10) Patent No.: US 9,398,377 B2
(45) Date of Patent: Jul. 19, 2016

(54) PIEZOELECTRIC SOUND ELEMENT

(75) Inventors: Tadao Sunahara, Toyama (JP); Masahide Tamura, Toyama (JP); Osamu Kawasaki, Toyama (JP); Masaru Tsuchiya, Anjo (JP); Ryuta Suzuki, Anjo (JP); Makoto Tsuruta, Anjo (JP); Nobuhiro Miwa, Anjo (JP); Hitoshi Sakamoto, Anjo (JP)

(73) Assignees: HOKURIKU ELECTRIC INDUSTRY CO., LTD., Toyama-Shi (JP); ANDEN CO., LTD., Anjo (JP)

( * ) Notice: Subject to any disclaimer, the term of this patent is extended or adjusted under 35 U.S.C. 154(b) by 241 days.

(21) Appl. No.: 14/237,438

(22) PCT Filed: Aug. 2, 2012

(86) PCT No.: PCT/JP2012/069689
§ 371 (c)(1),
(2), (4) Date: Feb. 6, 2014

(87) PCT Pub. No.: WO2013/021906
PCT Pub. Date: Feb. 14, 2013

(65) Prior Publication Data

US 2014/0241550 A1 Aug. 28, 2014

(30) Foreign Application Priority Data

Aug. 8, 2011 (JP) ..... 2011-172986

(51) Int. Cl.
*H04R 25/00* (2006.01)
*H04R 17/00* (2006.01)
*G10K 9/122* (2006.01)

(52) U.S. Cl.
CPC ..... *H04R 17/00* (2013.01); *G10K 9/122* (2013.01)

(58) Field of Classification Search
CPC ..... H04R 1/323; H04R 19/005; H04R 19/04; H04R 1/24; H04R 15/02; H04R 1/288; H04R 23/00; H04R 2440/07; H04R 17/00; H04R 19/013; H04R 1/00; H04R 1/04; H04R 1/345; H04R 1/38; H04R 2499/11; H04R 31/00; G10K 9/122
USPC ..... 381/191, 152, 190, 150, 174, 355, 423, 381/113, 116, 396, 412, 430; 73/715; 181/153; 399/261, 272, 274
See application file for complete search history.

(56) References Cited

U.S. PATENT DOCUMENTS 6,195,440 B1 * 2/2001 Warnaka ..... H04R 17/00 381/190
6,445,108 B1 9/2002 Takeshima et al.
(Continued)

FOREIGN PATENT DOCUMENTS

| | | |
|---|---|---|
| JP | 3360558 | 10/2002 |
| JP | 3446685 | 7/2003 |
| JP | 2003-230193 | 8/2003 |
| JP | 2004-221790 | 8/2004 |

(Continued)

*Primary Examiner* — Paul S Kim
*Assistant Examiner* — Norman Yu
(74) *Attorney, Agent, or Firm* — Rankin, Hill & Clark LLP

(57) ABSTRACT

A piezoelectric sound generating element capable of providing flatter and less fluctuated sound pressure frequency characteristics includes a diaphragm that is formed in a circular plate shape with a circular profile. A piezoelectric element is affixed to the side of a bottom wall portion of the diaphragm. The piezoelectric element has an asymmetric octagonal profile including a pair of long side portions opposing each other, a pair of short side portions opposing each other, and four connecting side portions.

2 Claims, 5 Drawing Sheets

(56) References Cited

U.S. PATENT DOCUMENTS

| | | | | |
|---|---|---|---|---|
| 6,587,567 | B1 | 7/2003 | Yamamoto | |
| 6,924,584 | B2 * | 8/2005 | Buhler | H01L 41/0973 310/324 |
| 2003/0099371 | A1 | 5/2003 | Ogura et al. | |

FOREIGN PATENT DOCUMENTS

| | | |
|---|---|---|
| JP | 2004-221903 | 8/2004 |
| JP | 2005-311679 | 11/2005 |
| JP | 2006-303770 | 11/2006 |
| JP | 2011-114597 | 6/2011 |

* cited by examiner

PIEZOELECTRIC SOUND ELEMENT

TECHNICAL FIELD

The present invention relates to a piezoelectric sound generating element having a piezoelectric element and a diaphragm to which the piezoelectric element is affixed, the diaphragm having a fixed outer peripheral portion.

BACKGROUND ART

FIG. 1 of JP3446685 (Patent Document 1) illustrates the structure of a piezoelectric sound generating element according to the related art in which a diaphragm has a circular profile and a piezoelectric element has a circular profile. In addition, FIG. 7 of Patent Document 1 illustrates the structure of a piezoelectric sound generating element according to the related art in which a diaphragm has a quadrangular profile and a piezoelectric element has a quadrangular profile. In the structure of the piezoelectric sound generating element according to the related art illustrated in FIG. 1 of Patent Document 1, the distance between the profile of the piezoelectric element and the profile of the diaphragm is constant. In the structure of the piezoelectric sound generating element according to the related art illustrated in FIG. 7 of Patent Document 1, the profile of the piezoelectric element and the profile of the diaphragm are parallel with each other at all locations. Therefore, with such structures according to the related art, it is difficult to disperse resonance and make sound pressure frequency characteristics as flat as possible.

FIG. 3 of JP2005-311679A (Patent Document 2) illustrates the structure of a piezoelectric sound generating element according to the related art in which a diaphragm has a quadrangular profile and a piezoelectric element has an octagonal profile. In the piezoelectric sound generating element according to the related art, the profile of the piezoelectric element and the profile of the diaphragm are parallel with each other in some portions, and are not parallel with each other in other portions. The piezoelectric sound generating element described in Patent Document 2 provides sound pressure frequency characteristics that are flatter than those of the piezoelectric sound generating element described in Patent Document 1.

FIGS. 14 and 15 of JP3360558 (Patent Document 3) illustrates a piezoelectric sound generating element in which a piezoelectric element has a circular profile and a diaphragm has a non-quadrangular profile obtained by cutting off a part of a rectangular profile.

FIG. 6 of JP2004-221903A (Patent Document 4) illustrates a piezoelectric sound generating element in which a piezoelectric element with an elliptical profile is affixed to a diaphragm with a quadrangular profile to form a piezoelectric vibrating body, which is covered with a resin sheet (a member that is deformed according to vibration of a power generating vibrating body) that is larger than the piezoelectric vibrating body, the resin sheet having a fixed periphery.

RELATED-ART DOCUMENT

Patent Document

Patent Document 1: JP3446685
Patent Document 2: JP2005-311679A
Patent Document 3: JP3360558
Patent Document 4: JP2004-221930A

SUMMARY OF INVENTION

Technical Problem

The piezoelectric sound generating element described in Patent Document 3, in which the piezoelectric element has a circular profile and the diaphragm has a non-quadrilateral profile obtained by cutting off a part of a quadrangular profile, provides sound pressure frequency characteristics that are flatter than those of the piezoelectric sound generating elements according to Patent Documents 1 and 2. However, it is difficult to uniformly fix the outer edge portion of the diaphragm of a non-quadrangular shape, and fluctuations in sound pressure frequency characteristics may be increased.

In the piezoelectric sound generating element described in Patent Document 4, the periphery of the resin sheet (a member that is deformed according to vibration of the power generating vibrating body) which covers the piezoelectric sound generating element is fixed, and therefore the periphery of the diaphragm may not be firmly fixed. Therefore, fluctuations in sound pressure frequency characteristics maybe increased compared to the piezoelectric sound generating elements described in Patent Documents 1 to 3, although the piezoelectric sound generating element described in Patent Document 4 provides flatter sound pressure frequency characteristics.

An object of the present invention is to provide a piezoelectric sound generating element capable of providing flatter and less fluctuated sound pressure frequency characteristics compared to those according to the related art.

Solution to the Problem

The present invention improves a piezoelectric sound generating element having a piezoelectric element and a diaphragm to which the piezoelectric element is affixed, the diaphragm having a fixed outer peripheral portion. In the piezoelectric sound generating element according to the present invention, the diaphragm has a circular profile. The profile of the piezoelectric element is determined such that any portion of the profile of the piezoelectric element is not parallel with the profile of the diaphragm. If a portion of the profile of the piezoelectric element is parallel with a portion of the profile of the diaphragm, the piezoelectric sound generating element has a constant hardness in such portions . If there are a larger number of such portions with a constant hardness, there is a larger difference in amplitude among sound pressures at a plurality of resonance points, which makes it difficult to achieve flat sound pressure frequency characteristics. According to the present invention, the profile of the piezoelectric element is determined such that any portion of the profile of the piezoelectric element is not parallel with the circular profile of the diaphragm, and therefore there are not any portions in which the piezoelectric sound generating element has a constant hardness. Therefore, there is a smaller difference in amplitude among sound pressures at a plurality of resonance points, which makes it easy to achieve flat sound pressure frequency characteristics. As a result, it is possible to generate a sound over a wide frequency range compared to that of the related art.

Specific examples of the profile of the piezoelectric element according to the present invention include polygonal profiles. Polygonal profiles mean shapes having three or more corner portions. Use of such a piezoelectric element having a polygonal profile for a diaphragm with a circular profile results in the two profiles having no parallel portions. Thus, it is possible to provide a piezoelectric sound generating element that reliably achieves the effect of the present invention by adopting such a configuration.

The piezoelectric element preferably has an octagonal profile. An octagonal profile is easily obtained by cutting off the corners of a quadrangular profile, and has corner portions with obtuse angles. Therefore, there is a low possibility of separation between the piezoelectric element and the diaphragm at the corner portions of the piezoelectric element. Thus, it is possible to provide a piezoelectric sound generating element with high mechanical strength.

The piezoelectric element may have a symmetrical or asymmetrical octagonal profile. Adopting an asymmetrical octagonal profile results in flatter sound pressure frequency characteristics due to the asymmetry. The asymmetric octagonal profile may have a pair of long side portions opposing each other, a pair of short side portions opposing each other in a direction orthogonal to the direction in which the pair of long side portions are opposing each other, and four connecting side portions that are shorter than the long side portions and the short side portions and that connect the long side portions and the short side portions. If the piezoelectric element has such a profile, the size of the piezoelectric element can be increased close to a size with which the piezoelectric element is inscribed in a circle. This leads to an increased sound pressure. The pair of long side portions may extend in parallel with each other, and the pair of short side portions may extend in parallel with each other. In this case, the piezoelectric element is easily formed. Alternatively, the pair of long side portions may extend in non-parallel with each other, and the pair of short side portions may extend in parallel with each other. In this case, the pair of long side portions may be shaped to be curved convexly toward the profile of the diaphragm. If the long side portions have such a curved shape, the area of the piezoelectric element can be further increased to increase the sound pressure.

The four connecting side portions may have a straight shape. This facilitates determination of the shape of the piezoelectric element. In addition, the four connecting side portions may be equal in length, each pair of the connecting side portions opposing each other may be equal in length, or each pair of the connecting side portions opposing each other maybe different in length. In any case, the sound pressure frequency characteristics become flatter as the asymmetry of the piezoelectric element is increased.

The present invention is also applicable to a case where the diaphragm has a polygonal profile, and the piezoelectric element has a circular profile. With such a configuration, the profile of the diaphragm and the circular profile of the diaphragm have no parallel portions. Thus, such a configuration also results in flatter sound pressure frequency characteristics. In this case, the polygonal profile is preferably quadrangular. The diaphragm with a quadrangular profile can be stably fixed, which is unlikely to result in fluctuations in characteristics.

The diaphragm may be formed from an insulating resin film. This makes it easy to obtain a diaphragm with a desired hardness.

DESCRIPTION OF EMBODIMENTS

Figure 1:
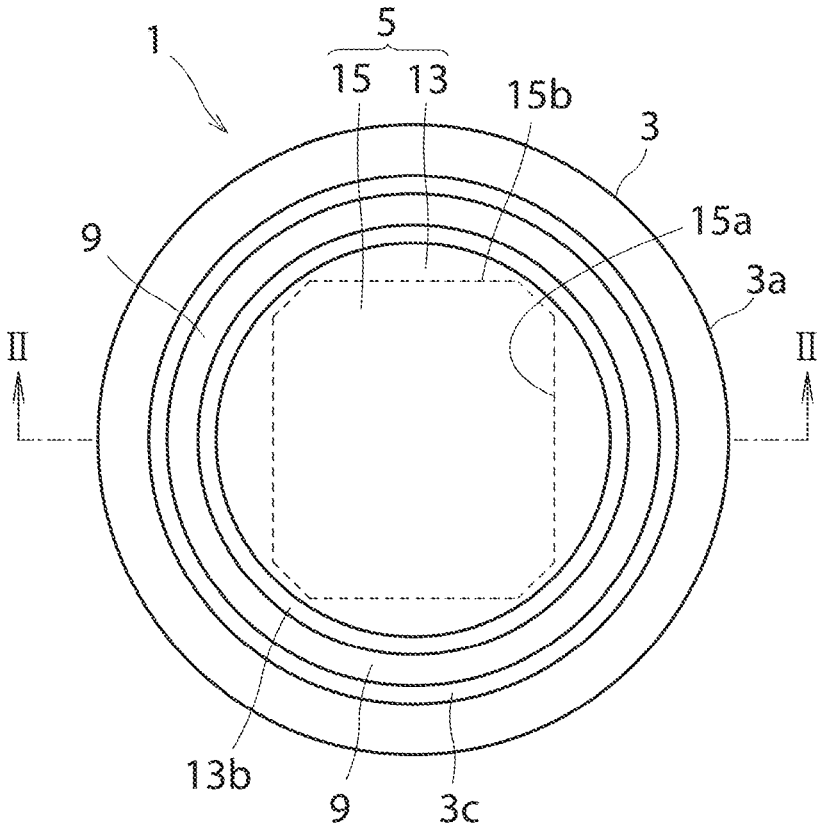
FIG. 1 is a plan view of a piezoelectric sound generating device including a piezoelectric sound generating element according to an embodiment of the present invention.
Figure 2:
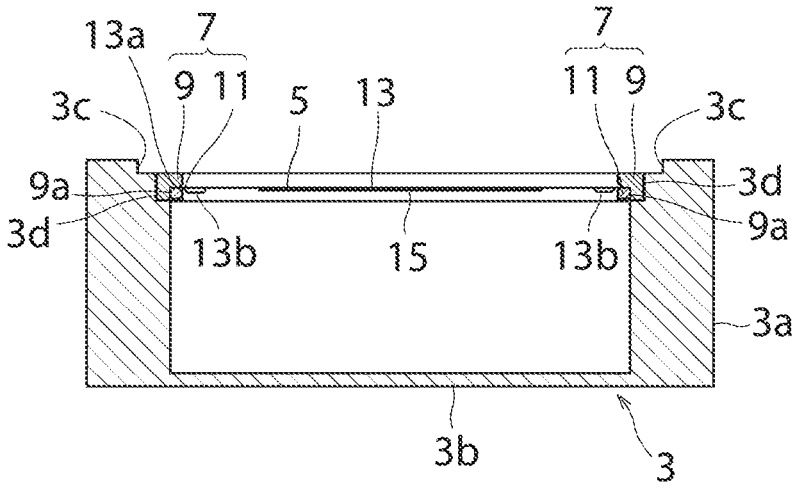
FIG. 2 is a cross-sectional view taken along the line II-II of FIG. 1.

A piezoelectric sound generating element according to an embodiment of the present invention will be described below with reference to the drawings. FIG. 1 is a plan view of a piezoelectric sound generating device 1 including a piezoelectric sound generating element according to the embodiment. FIG. 2 is a cross-sectional view of the piezoelectric sound generating device 1 illustrated in FIG. 1 taken along line II-II. In the embodiment, in order to facilitate understanding, some components are depicted with exaggeration in terms of thicknesses. The piezoelectric sound generating device 1 illustrated in FIGS. 1 and 2 may be used as a speaker built in a cellular phone, for example. The piezoelectric sound generating device 1 has a base portion 3 and a piezoelectric sound generating element 5 supported by the base portion 3.

The base portion 3 is constituted from a peripheral wall portion 3*a* formed in a cylindrical shape, and a bottom wall portion 3*b* formed in a circular plate shape and provided at one end portion of the peripheral wall portion 3*a*. The peripheral wall portion 3*a* and the bottom wall portion 3*b* of the base portion 3 are integrally formed from an insulating resin material such as PBT (polybutylene terephthalate). A first annular stepped portion 3*c* and a second annular stepped portion 3*d* are formed in a staircase shape at an inner peripheral portion of the other end portion of the peripheral wall portion 3*a*. A cover member (not illustrated) or the like is placed on the first annular stepped portion 3*c*. An annular fixing member 7 is provided at the second annular stepped portion 3*d*.

A fixing member 7 includes a support member 9 formed in an annular shape, and an O-ring 11 formed in an annular shape. The support member 9 is formed from an insulating resin material such as PBT, and has an annular stepped portion 9*a* that opens toward the bottom wall portion 3*b* of the base portion 3 and the radially inner side. The O-ring 11 is formed from a rubber material, and sized to be tightly fitted in the annular stepped portion 9*a* of the support member 9. An outer peripheral portion 13*a* of a diaphragm 13 is held between the support member 9 and the O-ring 11 fitted in the annular stepped portion 9*a* of the support member 9. Although the O-ring 11 does not slip off in this state, the second annular stepped portion 3*d* may be shaped to extend radially inward to face at least a part of the O-ring 11 in order that the second annular stepped portion 3*d* further prevents the O-ring 11 from slipping off. The support member 9 is bonded or welded to the second annular stepped portion 3*d* of the base portion 3. With such a structure, the outer peripheral portion 13*a* of the diaphragm 13 is held between the support member 9 and the O-ring 11 so that the diaphragm 13 is fixed with respect to the base portion 3.

The piezoelectric sound generating element 5 has the diaphragm 13 which is formed from an insulating resin film, and a piezoelectric element 15 affixed to the diaphragm 13 using an adhesive. The diaphragm 13 is formed in a circular plate shape with a circular profile. An annular projected portion 13*b* is continuously formed along an outer edge portion of the diaphragm 13. The annular projected portion 13*b* is formed to project toward the bottom wall portion 3*b* of the base portion 3. The annular projected portion 13*b* is provided for the purpose of increasing the flexibility of the diaphragm 13 through expansion and contraction during operation of the piezoelectric sound generating element 5. The annular outer peripheral portion 13*a*, which is to be held between the support member 9 and the O-ring 11, is formed radially outwardly of the annular projected portion 13*b*.

Figure 3:
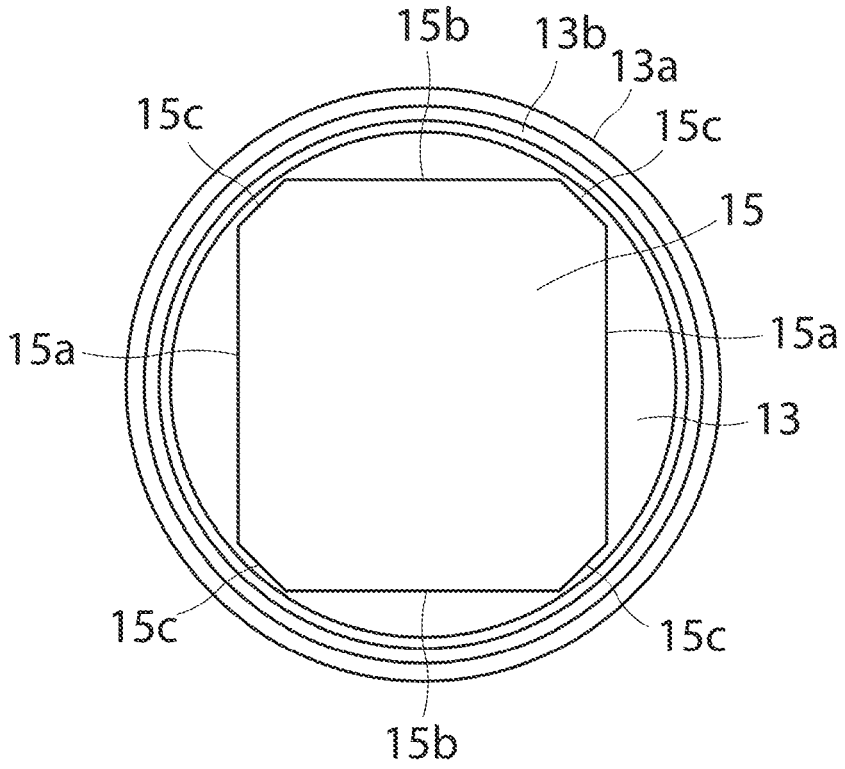
FIG. 3 is a view of the piezoelectric sound generating element of FIG. 1 as seen from the side of a bottom wall portion of a base portion.

FIG. 3 is a view of the piezoelectric sound generating element 5 as seen from the bottom wall portion 3*b* side. The piezoelectric element 15 is affixed to a surface of the diaphragm 13 facing the bottom wall portion 3*b*. The piezoelectric element 15 of the present embodiment includes a pair of long side portions opposing each other, a pair of short side portions 15*b* opposing each other, and four connecting side portions 15*c*. That is, the piezoelectric element 15 of the present embodiment has an asymmetric octagonal profile. The pair of long side portions 15*a* are formed to extend in parallel with each other and be equal in length. The pair of short side portions 15*b* are formed to extend in parallel with each other and be equal in length. In the embodiment, the pair of long side portions 15*a* and the pair of short side portions 15*b* are straight in shape.

The four connecting side portions 15*c* are shorter than the long side portions 15*a* and the short side portions 15*b*, and connect adjacent end portions of the long side portions and the short side portions. In the embodiment, the four connecting side portions 15*c* are formed to be straight in shape and equal in length.

Figure 4A:
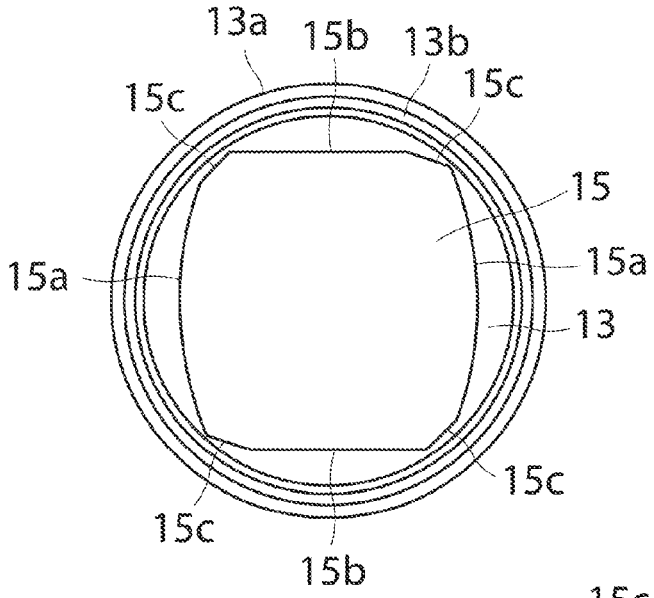
FIGS. 4A to 4C are each a view of a piezoelectric sound generating element according to a modification as seen from the side of a bottom wall portion of a base portion.
Figure 4B:
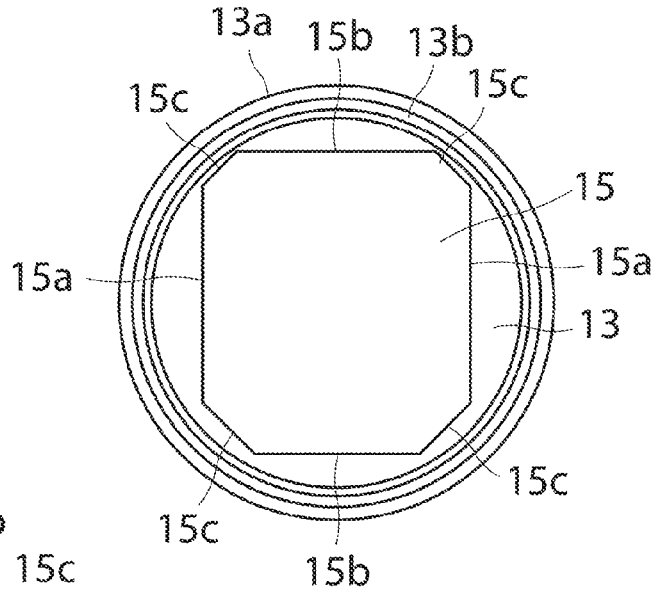
Figure 4C:
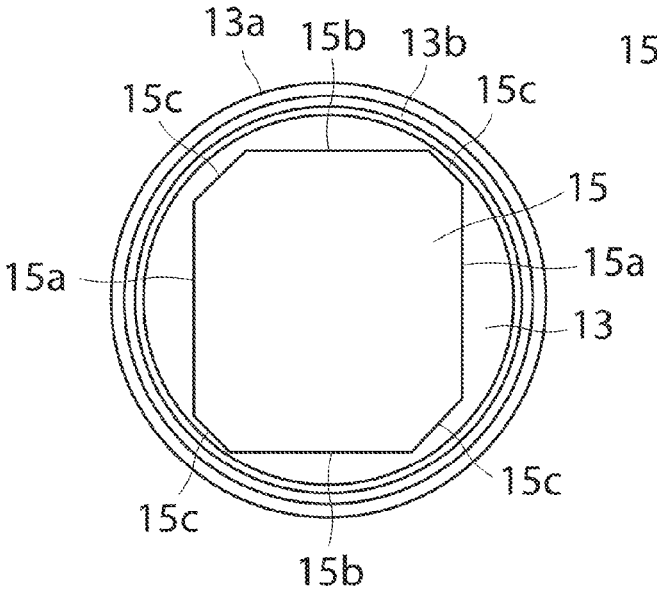

FIGS. 4A to 4C each illustrate a piezoelectric element 15 according to a modification. In FIG. 4A, the pair of long side portions 15*a* of the piezoelectric element 15 are curved to be convex toward the profile of the diaphragm. In FIG. 4C, each pair of the connecting side portions opposing each other are equal in length. In FIG. 4B, each pair of the connecting side portions connected to both ends of each short side portion are equal in length.

If a portion of the profile of the piezoelectric element is parallel with a portion of the profile of the diaphragm, the piezoelectric sound generating element has a constant hardness in such portion. If there are a larger number of such portions with a constant hardness, there is a larger difference in amplitude at a plurality of resonance points that appear in the sound pressure frequency characteristics, which makes it difficult to achieve flat sound pressure frequency characteristics. In each of the embodiments described above, the profile of the piezoelectric element 15 is determined such that any portion of the profile of the piezoelectric element 15 is not parallel with the profile of the diaphragm 13, and thus there are not any portions in which the piezoelectric sound generating element 1 has a constant hardness. Therefore, there is a smaller difference in amplitude at a plurality of resonance points that appear in the sound pressure frequency characteristics, which makes it easy to achieve flat sound pressure frequency characteristics. As a result, it is possible to generate a sound over a wide frequency range compared to the related art.

Figure 5:
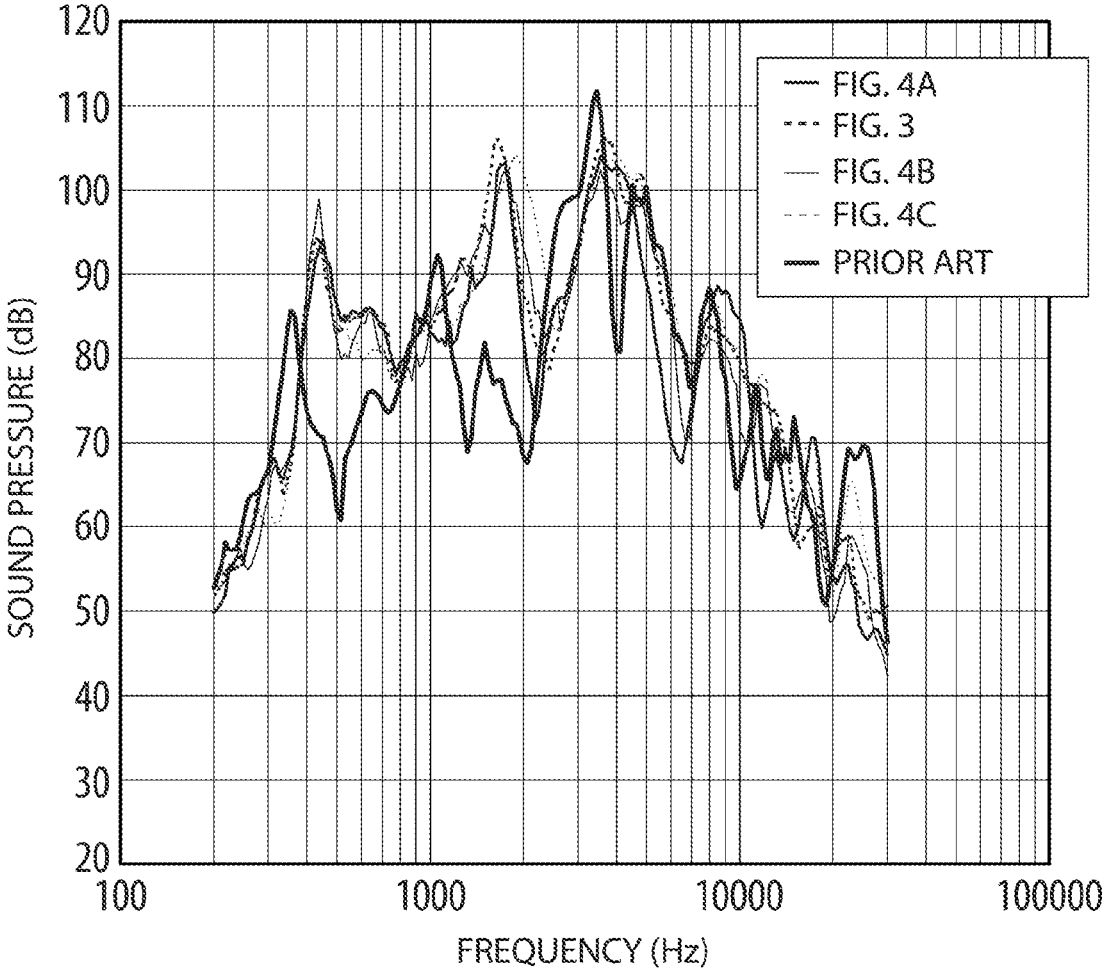
FIG. 5 is a graph illustrating the sound pressure frequency characteristics of a piezoelectric speaker that uses a piezoelectric sound generating element according to the related art, and the sound pressure frequency characteristics of piezoelectric speakers that use the piezoelectric sound generating elements according to the four embodiments of the present invention illustrated in FIGS. 1 to 4.

FIG. 5 is a graph illustrating the sound pressure frequency characteristics of a piezoelectric speaker that uses a conventional piezoelectric sound generating element, and the sound pressure frequency characteristics of piezoelectric speakers that use the piezoelectric sound generating elements according to the four embodiments of the present invention illustrated in FIGS. 1 to 4. In the conventional piezoelectric sound generating element, the diaphragm has a quadrangular profile and the piezoelectric element has a quadrangular profile. In the conventional piezoelectric sound generating element, the sound pressure drops to about 60 dB in a frequency band around 500 Hz. In addition, the sound pressure drops to 70 dB or less at frequencies around 1050 Hz and around 2000 Hz. That is, with the conventional piezoelectric sound generating element, the sound pressure significantly drops in a plurality of frequency bands in low to mid ranges. With the piezoelectric sound generating elements according to the four embodiments illustrated in FIGS. 1 to 4, in contrast, the sound pressure does not fall below 75 dB in a frequency range from 400 Hz to 2000 Hz. As a result, with the piezoelectric sound generating element according to the present invention, it is possible to obtain good sound pressure frequency characteristics in which the sound pressure does not significantly drop over a wide frequency band in a part of low to mid ranges compared to the conventional piezoelectric sound generating element.

Although the piezoelectric element has an asymmetric octagonal profile in each of the embodiments described above, the profile of the piezoelectric element is not limited thereto. For example, the piezoelectric element may have a symmetric octagonal profile such as a regular octagonal profile, or other polygonal profiles such as quadrangular and hexagonal profiles. Alternatively, the piezoelectric element may have an elliptical profile, for example, if any portion of the profile of the piezoelectric element is not parallel with the profile of the diaphragm.

In the piezoelectric sound generating element according to the embodiment described above, the diaphragm has a circular profile and the piezoelectric element has a polygonal profile. However, the piezoelectric element may have a circular profile and the diaphragm may have a polygonal profile such as a quadrangular profile, for example.

INDUSTRIAL APPLICABILITY

According to the present invention, the profile of the piezoelectric element is determined such that any portion of the profile of the piezoelectric element is not parallel with the profile of the diaphragm, and therefore there are not any portions in which the piezoelectric sound generating element has a constant hardness. Therefore, there is a smaller difference in amplitude at a plurality of resonance points, which makes it easy to achieve flat sound pressure frequency characteristics. As a result, it is possible to generate a sound over a wide frequency range compared to the related art.

DESCRIPTION OF REFERENCE NUMERALS

1 piezoelectric sound generating device
3 base portion
3*a* peripheral wall portion
3*b* bottom wall portion
3*c* first annular stepped portion
3*d* second annular stepped portion
5 piezoelectric sound generating element
7 fixing member
9 support member
9*a* annular stepped portion
11 O-ring
13 diaphragm
13*a* outer peripheral portion
13*b* projected portion
15 piezoelectric element

15*a* long side portion
15*b* short side portion
15*c* connecting side portion

The invention claimed is:

1. A piezoelectric sound generating element comprising a piezoelectric element and a diaphragm to which the piezoelectric element is affixed, the diaphragm having a fixed outer peripheral portion, wherein:

the diaphragm has a circular profile;

a profile of the piezoelectric element is determined such that any portion of the profile of the piezoelectric element is not parallel with the profile of the diaphragm;

the piezoelectric element has an asymmetric octagonal profile;

the asymmetric octagonal profile has a pair of long side portions opposing each other, a pair of short side portions opposing each other in a direction orthogonal to the direction in which the pair of long side portions are opposing each other, and four connecting side portions that are shorter than the long side portions and the short side portions and that connect the long side portions and the short side portions;

the pair of long side portions extend in non-parallel with each other, and the pair of short side portions extend in parallel with each other;

the pair of long side portions are shaped to be curved convexly toward the profile of the diaphragm;

the four connecting side portions have a straight shape; and the four connecting side portions are equal in length, each pair of the connecting side portions opposing each other are equal in length, or each pair of the connecting side portions opposing each other are different in length.

2. The piezoelectric sound generating element according to claim 1, wherein the diaphragm is formed from an insulating resin film.

* * * * *